United States Patent [19]

Winterbottom

[11] Patent Number: 4,773,347

[45] Date of Patent: Sep. 27, 1988

[54] BOAT STEERING DEVICE

[76] Inventor: Bruce Winterbottom, Box 46, River Rd. - Lower Bank, Egg Harbor, N.J. 08215

[21] Appl. No.: 563,059

[22] Filed: Dec. 19, 1983

[51] Int. Cl.[4] ..... B63H 25/06

[52] U.S. Cl. ..... 114/166; 440/67

[58] Field of Search ..... 440/66, 67, 38, 40, 440/43; 60/221, 222; 239/265.33, 265.43; 114/166, 152; 416/179, 189; 415/116, 126

[56] References Cited

U.S. PATENT DOCUMENTS 2,803,211 8/1957 Erlbacher ..... 114/166
3,115,112 12/1963 Erlbacher ..... 60/221
3,149,605 9/1964 Broadwell ..... 440/67
3,244,135 4/1966 Meyerhoff ..... 440/63

*Primary Examiner*—Joseph F. Peters, Jr.
*Assistant Examiner*—Jesûs D. Sotelo
*Attorney, Agent, or Firm*—Charles I. Brodsky

[57] ABSTRACT

A steering device, particularly attractive for use with power driven boats, is in the general shape of a cylinder positioned aft, or rearwardly, of the propeller employed, and is arranged to direct the flow of the propelled water in the direction in which the boat is intended to be turned, so as to afford an improved handling of operation. In a preferred embodiment, the diameter of the cylinder is selected to encircle the propeller driving the power boat.

2 Claims, 1 Drawing Sheet

BOAT STEERING DEVICE

FIELD OF THE INVENTION

This invention relates to steering devices for boats and, more particularly, to such a device to enable better handling of power driven boats in either "forward" or "reverse" gears.

BACKGROUND OF THE INVENTION

As is well known and understood, the most common method presently used for steering power boats of the recreational variety is by means of a movable flat rudder hinged vertically at the stern.

As is also well known, associated with such rudder usage are such characteristics as maneuverability, turning distance, and ease of handling. To most purchasers, such characteristics do not generally influence the question whether to purchase one power boat over another—although such differences between boats can usually be detected. With off-shore, or racing, boats, on the other hand, the characteristics associated with individual designs are of greater importance, as oftentimes representing the difference between winning or losing a race.

SUMMARY OF THE INVENTION

As will become clear hereinafter, the steering device of the invention is conceptually different from the commonly found rudder usage in that it is generally in the shape of a cylinder positioned aft, or rearwardly, of the propeller employed. With such configuration, the steering device is arranged to direct the flow of the propelled water in the direction in which the boat is intended to turn—both when the boat is in its "forward" gear, as well as in its "reverse" operational mode. While generally of the cylinder configuration, the steering device embodying a preferred version of the invention is tapered at the end closest to the propeller, so as to ensure that there is an absence of contact between them, in affording sufficient clearance. At the same time, a tab section is cut into the cylinder wall furthest from the propeller, and bent slightly outwardly, so as to minimize any tendency for the propeller rotation itself to cause the boat to turn.

As will become more apparent from the description that follows, several advantages follow from the cylindrical construction of the steering device in this manner. First, a very significant ease of handling was noted, along with a substantial ease in turning, together with increasing the speed with which the turning action responds. Because of the configuration of the steering device, such ease of handling was noted to exist while the boat was moving forwardly—with the moving water being propelled through the cylindrical device—as well as when moving rearwardly—when the moving water was sucked through the steering device towards the propeller. With the particular configuration constructed according to the preferred embodiment of the invention, furthermore, the power-driven boat was also noted to steer straight ahead, without any noticeable turning, even though the steering wheel was not being held—as contradistinct from prior art constructions, where the boat tended to drift and turn of its own volition. Additionally, it was found that the ease of handling, along with the improved maneuverability, existed substantially unaffected by the speed at which the vessel was travelling at.

BRIEF DESCRIPTION OF THE DRAWING

These and other features of the present invention will be more clearly understood from a consideration of the following description, taken in connection with the accompanying drawing, in which.

DETAILED DESCRIPTION OF THE DRAWING

Figure 1:
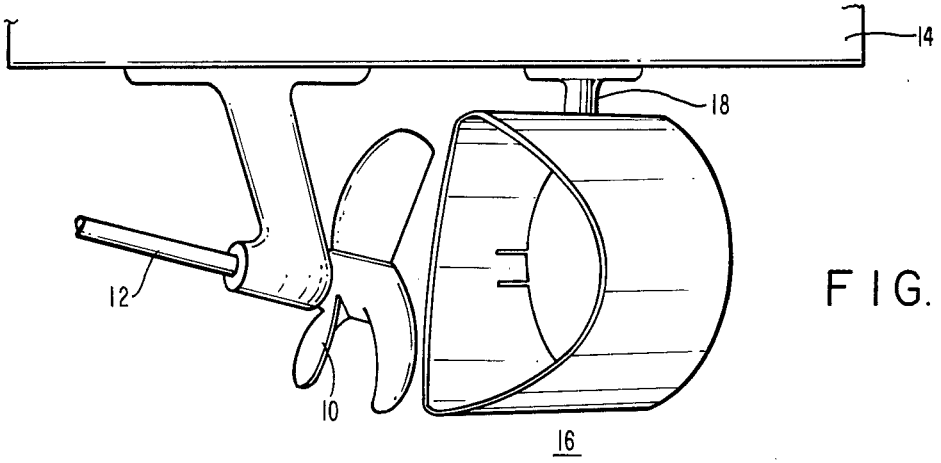
FIG. 1 illustrates the respective positioning of the steering device of the invention with respect to the propeller of a typical power-driven boat.

Referring to FIG. 1, the propeller for the power-driven boat is shown at 10, as extending from a drive shaft 12, and attached to the hull of the vessel 14. The steering device of the invention is shown at 16, at the end of a stock 18 extending upwardly into the boat, and operated by means of a push-pull cable control coupled to the steering wheel (not shown).

Figure 2:
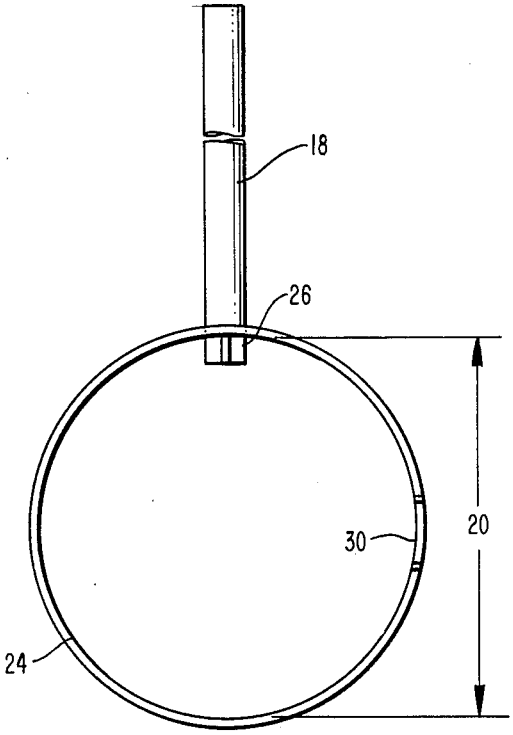
FIGS. 2–4 illustrate rear, top and left-side views of the steering device of FIG. 1.
Figure 4:
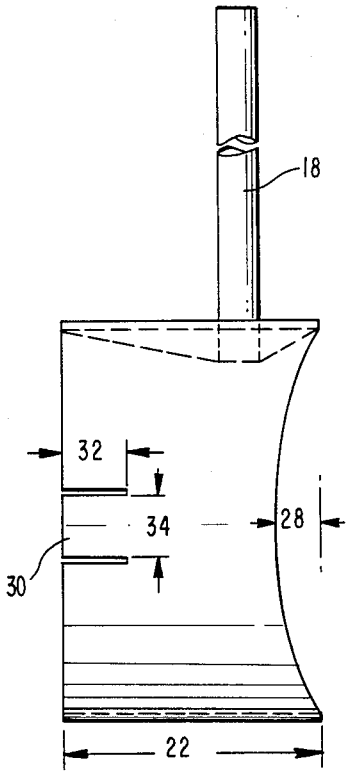
Figure 3:
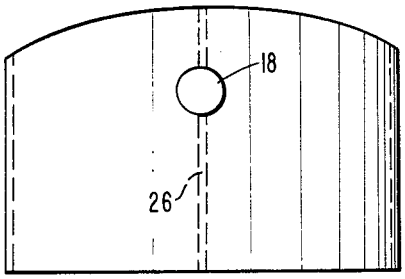

As more clearly illustrated in FIGS. 2–4, the steering device 16 is of a generally cylindrical construction, having an internal diameter 20 of some 12 inches in a preferred embodiment, an overall depth 22 of some 8 inches, and with a wall thickness 24 approximately 3/16 inches. The stock 18 passes into the cylindrical steering device 16 where it is welded with a series of gussets 26 so as to limit any vibrations that might be present. As shown in FIGS. 3 and 4, the steering device 16 is tapered somewhat from the back toward the front, by an amount 28 sufficient to serve as clearance to the blades of the propeller 10 which are proximately situate to it (FIG. 1). In the preferred embodiment of the invention, and with the dimensions previously noted, such taper dimension 28 is approximately 2½ inches when the propeller 10 would be of a 12 inch diameter, with a 13 pitch on it, positioned some 4 inches in front of the steering device 16. Lastly shown is a tab 30 cut into one sidewall of the steering device 16—which, in a preferred embodiment of the invention, is cut in to a depth 32 of approximately 2 inches, with a height 34 of a like 2 inches. Although shown in FIG. 2 as it would appear prior to any adjustment being made, it is to be understood that the tab 30 is to be bent somewhat outwardly of the cylindrical configuration in use, by an angle of approximately 5° (to the right, in FIG. 2).

Such a steering device as above described has been installed on a 26 foot long power boat, and has significantly improved its handling characteristics. In particular, the steering device of the invention has greatly improved the turning capability of the boat, making it faster to respond to a directional turn of the steering wheel aboard. In such event, the moving water is propelled through the cylindrical steering device, in effect oreficing the water through the device as the boat is moving forward. At the same time, because the water would then be sucked in through the cylindrical housing towards the propeller while the boat is in reverse, an improved steering has been found to then exist, also, making the boat both easier and faster to turn when in "reverse" gear. In like manner, it has been found that any tendency for the propeller, itself, to turn the boat is overcome by the action of the outwardly extending tab 30, the degree of which can be controlled by the extent of the angular bending outwardly which is afforded thereto. With the dimensions set forth as representing one preferred embodiment of the invention, it has been found easy, for purposes of illustration, to make a complete U-turn in 26 feet of forward motion for the 26 foot boat on which the invention has been incorporated. And, even with the hands being taken off the steering wheel, the device of the invention has been determined to steer the boat perfectly straight, while moving forwardly or rearwardly, as the outwardly extending tab 30 effectively lessens the pressure otherwise produced on the steering device by the torque action of the propeller.

A further advantage to the invention follows from the placement of the steering device with respect to the positioning of the propeller. Thus, by maintaining the two separate and apart, it has been noted that the described operation continues in effect over a wide range of boat speeds. Analysis has indicated that if the cylindrical device was maintained too close to the propeller (though with sufficient tapering to continue the clearance between the two), a tendency could exist for a cavitational effect to be built up, in which a ring of air might be produced on the inside of the cylindrical construction—thereby limiting the cross-sectional area through which the moving water can flow. Under such circumstances, the benefits of the invention extend only towards a certain top vessel speed, beyond which the described characteristics are not as invariable. However, with the 4 inch, or so, separation between the two—as in the preferred embodiment—, experimentation has shown that the described effects continue substantially without degradation without any limit being placed upon forward speed.

While there has been described what is considered to be a preferred embodiment of the present invention, it will be readily apparent to those skilled in the art that modifications can be made without departing from the scope of the teachings herein. For example, although described for use with a 26 foot boat, it will be appreciated that modifications can be made in the various dimensionings of the steering device if a different boat size were used, and different positionings could be selected dependent upon the particular size and pitch characteristics of the propeller employed. Larger boats, as an illustration, might then require greater dimensions and spacings, whereas smaller boats could operate effectively with correspondingly smaller dimensions and positional locations. And, although described in the context of a power-driven boat, where the teachings of the invention are particularly applicable, it will be appreciated by those skilled in the art that the steering device design can be employed in a sailboat construction, where the moving water continues to flow smoothly, without chattering, through all surface areas of the cylindrical construction, rather than up against one flat side of a vertically hinged rudder, as in present day usage—even though such considerations as placement with respect to a propeller, or maintaining a straight course when going in reverse, are not matters of usual concern. For at least such reasons, therefore, resort should be had to the claims appended hereto for a true understanding of the scope of the invention, acknowledging, at the same time, that while a preferred operation follows where the diameter of the cylindrical device approximates the diameter of the propeller (so as to capture and direct substantially all the water-flow in the direction in which the vessel is desired to move), other modifications may be made in which the diameter of the cylinder is either larger, or smaller, than that of the propeller, the result there being just a lessening of the improvements over the prior art which are afforded by the preferred construction described. All that is necessary is that the cylindrical control be located rearwardly of the propeller provided, and so as to be aligned co-axially with it, and preferably provided with the longitudinal tab being angled outwardly with respect to the propeller by the amount appropriate to reduce any torque pressures exerted against the cylinder wall by the propelled waters.

I claim:

1. A steering device for a propeller driven power boat, comprising:

a control means, generally in the shape of a cylinder opened at its opposite ends; and means for securing said cylindrical control means to the hull of the boat at a point rearwardly of its propeller and in a direction coaxially therewith, and for imparting to said control means the directional turn indication translated from the steering controls of said boat;

with the end of said cylindrical control means facing the propeller of the boat being inwardly tapered as compared to the opposite end of said control means, so as to provide a degree of clearance to the propeller blades when in rotation;

with the inner diameter of said cylindrical control means being selected substantially equal to the diameter designation of the propeller of said power boat;

with one side wall of said cylindrical control means being longitudinally slotted in a direction extending from said opposite end of said control means towards said end of said control means facing the propeller of the boat, to form a tab;

and with said tab being angled outwardly of said cylindrical control means to reduce torque pressures exerted against said side wall by propelled waters when the power boat is in motion;

whereby when in both forward and rearward motion, propelled water is caused to flow through said cylindrical control means in a direction substantially the same as that in which the boat is then pointing.

2. The steering device of claim 1 wherein the inner diameter of said cylindrical control means is of the order of 12 inches; the length of said cylindrical control means is of the order of 8 inches, the inward tapering of the end of said cylindrical control means is of the order of 2 inches compared to the opposite end of said control means, and wherein the tab so formed in said side wall is angled outwardly of said cylindrical control means by the order of 5 degrees.

* * * * *